US008384001B2

(12) United States Patent
Jeong

(10) Patent No.: US 8,384,001 B2
(45) Date of Patent: Feb. 26, 2013

(54) MICROWAVE OVEN AND RECIPROCATING TRAY APPARATUS THEREOF

(75) Inventor: Sang Jin Jeong, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 366 days.

(21) Appl. No.: 12/662,002

(22) Filed: Mar. 26, 2010

(65) Prior Publication Data

US 2010/0301041 A1 Dec. 2, 2010

(30) Foreign Application Priority Data

May 29, 2009 (KR) ..... 10-2009-0047307

(51) Int. Cl.
*H05B 6/78* (2006.01)

(52) U.S. Cl. ..... 219/753; 219/754

(58) Field of Classification Search ..... 219/756
See application file for complete search history.

(56) References Cited

U.S. PATENT DOCUMENTS

2005/0016998 A1* 1/2005 Choi ..... 219/754

FOREIGN PATENT DOCUMENTS

JP 2001319770 * 5/2000

* cited by examiner

*Primary Examiner* — Mattew Reames
(74) *Attorney, Agent, or Firm* — Staas & Halsey LLP

(57) ABSTRACT

Disclosed herein is a microwave oven, in which a tray within a cooking room is rectilinearly reciprocated in a lengthwise direction of the cooking room and is rotated, simultaneously, to cook food. This is achieved using a gear assembly including a main gear and a planetary gear. The gear assembly includes the main gear and the planetary gear, which are engaged with each other and are rotated. A diameter of the main gear and a diameter of the planetary gear may be equal to each other, and the main gear and the planetary gear respectively include eccentric shafts. The gear assembly effectively transmits power supplied by a motor to the tray, thereby allowing the tray to be rotated at a uniform speed and to be driven even using a motor having a small load capacity.

23 Claims, 21 Drawing Sheets

MICROWAVE OVEN AND RECIPROCATING TRAY APPARATUS THEREOF

CROSS-REFERENCE TO RELATED APPLICATIONS

This application claims the benefit of Korean Patent Application No. 2009-0047307, filed on May 29, 2009 in the Korean Intellectual Property Office, the disclosure of which is incorporated herein by reference

BACKGROUND

1. Field

Embodiments of the present invention relate to a microwave oven, in which a tray within a cooking room is rectilinearly reciprocated and is rotated, simultaneously, to cook food.

2. Description of the Related Art

In general, a microwave oven is an appliance that irradiates high frequency radiation generated from a magnetron to the inside of a cooking room to repeatedly change a molecule arrangement of moisture contained within food and thus to cook the food using friction heat between molecules generated thereby.

Such a microwave oven includes a main body forming the external appearance of the microwave oven, and an inner space of the main body is divided into a cooking room located at the inside of an inner case having a rectangular parallelepiped shape and a machine room located at the outside of the inner case next to the inner case.

A tray configured to be rotated when food to be cooked is placed thereon is installed on a bottom within the cooking room, and the tray is rotated by a motor installed on an outer surface of the bottom of the cooking room. Further, a magnetron to generation high frequency radiation and irradiate the high frequency radiation to the inside of the cooking room, and a high voltage transformer and a high voltage condenser to apply high voltage to the magnetron are installed in the machine room.

When the microwave oven is operated through the above structure, the high frequency radiation generated from the magnetron is irradiated to the inside of the cooking room, and is irradiated to food rotated together with the tray, thereby cooking the food.

SUMMARY

Therefore, it is one aspect of the present embodiments to provide a microwave oven, in which a tray within a cooking room is rectilinearly reciprocated in a lengthwise direction of the cooking room and is rotated, simultaneously, to cook food.

It is a further aspect of the present embodiments to provide a microwave oven, in which a tray is rectilinearly reciprocated at a regular speed.

It is another aspect of the present embodiments to provide a microwave oven, in which a tray is rotated at a regular speed.

It is yet another aspect of the present embodiments to provide a microwave oven, in which a tray is driven even using a motor having a small load capacity.

Additional aspects will be set forth in part in the description which follows and, in part, will be obvious from the description, or may be learned by practice of the invention.

The foregoing and/or other aspects are achieved by providing a microwave oven including a main body having a cooking room, a tray disposed on a bottom surface of the cooking room, a motor to provide power to the tray, and a gear assembly changing the power supplied by the motor to drive the tray, the gear assembly including a main gear connected to the motor and rotatable, and a planetary gear engaged with the main gear and rotatable, at least one of the main gear and the planetary gear including an eccentric shaft having an eccentric distance from a center of the main gear and/or the planetary gear, respectively.

The tray may include a rectilinearly reciprocated sub-tray, and a rotary tray rotated on the sub-tray.

A diameter of the main gear and a diameter of the planetary gear may be substantially equal to each other, and the main gear and the planetary gear may respectively include eccentric shafts.

An eccentric distance of the eccentric shaft of the main gear to a center of the main gear and an eccentric distance of the eccentric shaft of the planetary gear to a center of the planetary gear may be equal to each other.

The gear assembly may further include a coupler connected to an upper surface of the planetary gear, the coupler connecting the rotary tray with the gear assembly.

The gear assembly may further include a guide protrusion connected to a lower surface of a rotary shaft of the planetary gear.

The bottom surface of the cooking room may include a base guide provided with a main gear shaft hole, through which an eccentric shaft formed on the main gear passes to be connected to the motor, and a guide groove, to which the guide protrusion is connected to be moved.

The base guide may be formed integrally with the bottom surface of the cooking room.

The gear assembly may further include a stirrer to disperse high frequency radiation in the cooking room.

An upper surface of the sub-tray may be disposed at a higher position than that of an upper surface of the rotary tray.

The rotary tray may be received in a rotary tray reception part in the sub-tray.

The gear assembly may further include at least one gear guide surrounding circumferences of the main gear and the planetary gear to facilitate rotation of the main gear and the planetary gear when the main gear and the planetary gear are engaged with each other, and at least one casing surrounding external surfaces of the at least one gear guide.

The gear assembly may further include a connection member connecting the main gear and the planetary gear to facilitate rotation of the main gear and the planetary gear when the main gear and the planetary gear are engaged with each other.

The connection member may include a transmission protrusion formed at one end thereof to transmit power to rectilinearly reciprocate the sub-tray, and the sub-tray may include a transmission protrusion groove, into which the transmission protrusion is inserted to be guided.

The sub-tray may have a circular shape, and be formed to have a smaller diameter than that of the rotary tray.

The sub-tray may include a fixing coupler fixed to a lower surface of the sub-tray and connected to the planetary gear.

A roller guide to facilitate rotation of the rotary tray on the sub-tray may be disposed between the sub-tray and the rotary tray.

The roller guide may be formed integrally with the sub-tray.

The foregoing and/or other aspects are achieved by providing a tray apparatus of a microwave including a sub-tray rectilinearly reciprocated in a lengthwise direction of a cooking room of the microwave, a rotary tray rotated on the sub-tray, a motor to provide power to the sub-tray and the rotary tray, and a gear assembly connected to the motor to operate the sub-tray and the rotary tray, the gear assembly including a main gear connected to the motor and rotatable and including an eccentric shaft, and a planetary gear engaged with the main gear and rotatable and including an eccentric shaft.

Diameters of the main gear and the planetary gear may be equal to each other, and distances respectively from central points of the main gear and the planetary gear to the eccentric shafts of the main gear and the planetary gear may be substantially equal to each other.

The foregoing and/or other aspects are achieved by providing a tray apparatus of a microwave including a sub-tray rectilinearly reciprocated in a lengthwise direction of a cooking room, a rotary tray rotated on the sub-tray, a motor to provide power to the sub-tray and the rotary tray, and a gear assembly connected to the motor to operate the sub-tray and the rotary tray, the gear assembly including a main gear connected to the motor and rotatable and including an eccentric shaft, and a planetary gear engaged with the main gear and rotatable.

The bottom surface of the cooking room may include a base guide provided with a main gear shaft hole, through which an eccentric shaft formed on the main gear passes to be connected to the motor, and a guide groove, to which the fixing coupler is connected to be moved.

The foregoing and/or other aspects are achieved by providing a microwave oven, including: a main body having a cooking room; a tray disposed on a bottom surface of the cooking room, the tray being simultaneously rectilinearly reciprocated and rotated; and a motor to provide power to the tray to rectilinearly reciprocate and rotate the tray.

The tray may include a sub-tray rectilinearly reciprocated in a lengthwise direction of the cooking room, and a rotary tray rotated on the sub-tray.

The microwave oven may further include a gear assembly including a main gear connected to the motor and rotatable and a planetary gear engaged with the main gear and rotatable, at least one of the main gear and the planetary gear including an eccentric shaft having an eccentric distance from a center of the main gear and/or the planetary gear.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
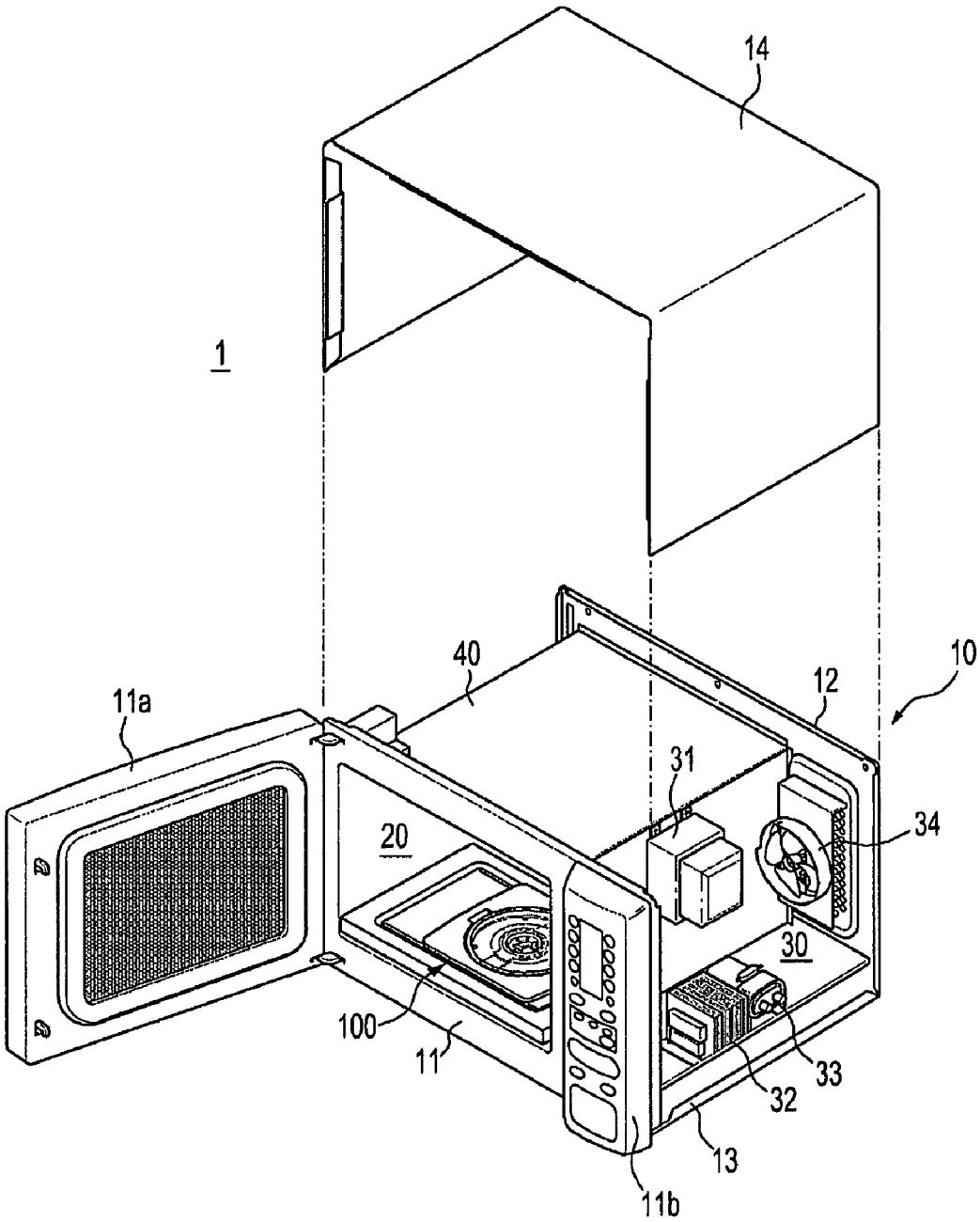
FIG. 1 is an exploded perspective view of a microwave oven in accordance with at least one embodiment.

Reference will now be made in detail to the embodiments, examples of which are illustrated in the accompanying drawings, wherein like reference numerals refer to like elements throughout.

Hereinafter, at least one embodiment will be described in detail with reference to the accompanying drawings.

Figure 2:
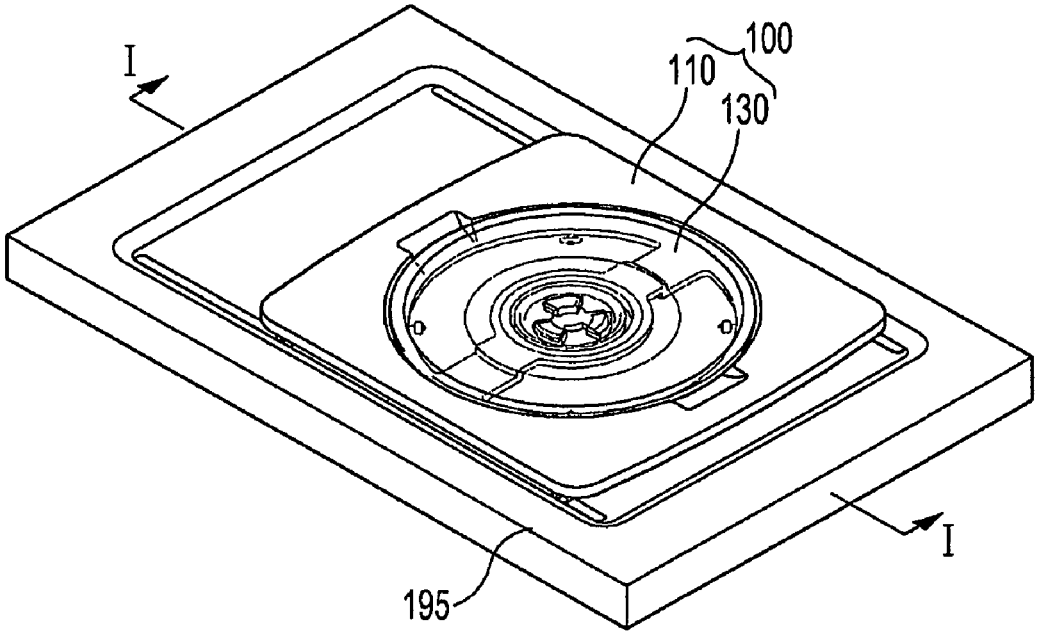
FIG. 2 is a perspective view illustrating an installation state of a tray in accordance with at least one embodiment.
Figure 3:
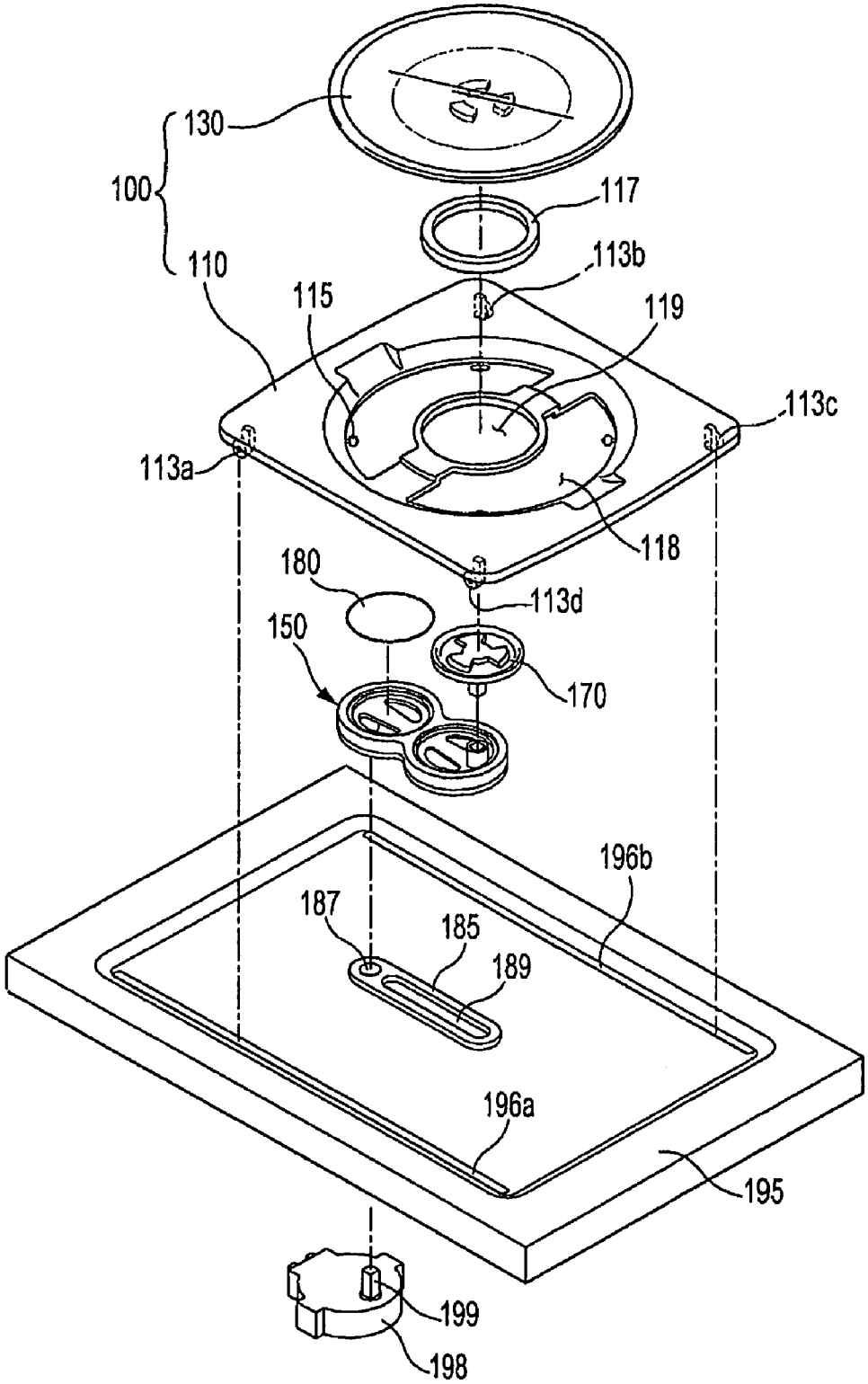
FIG. 3 is an exploded perspective view of FIG. 2.
Figure 4:
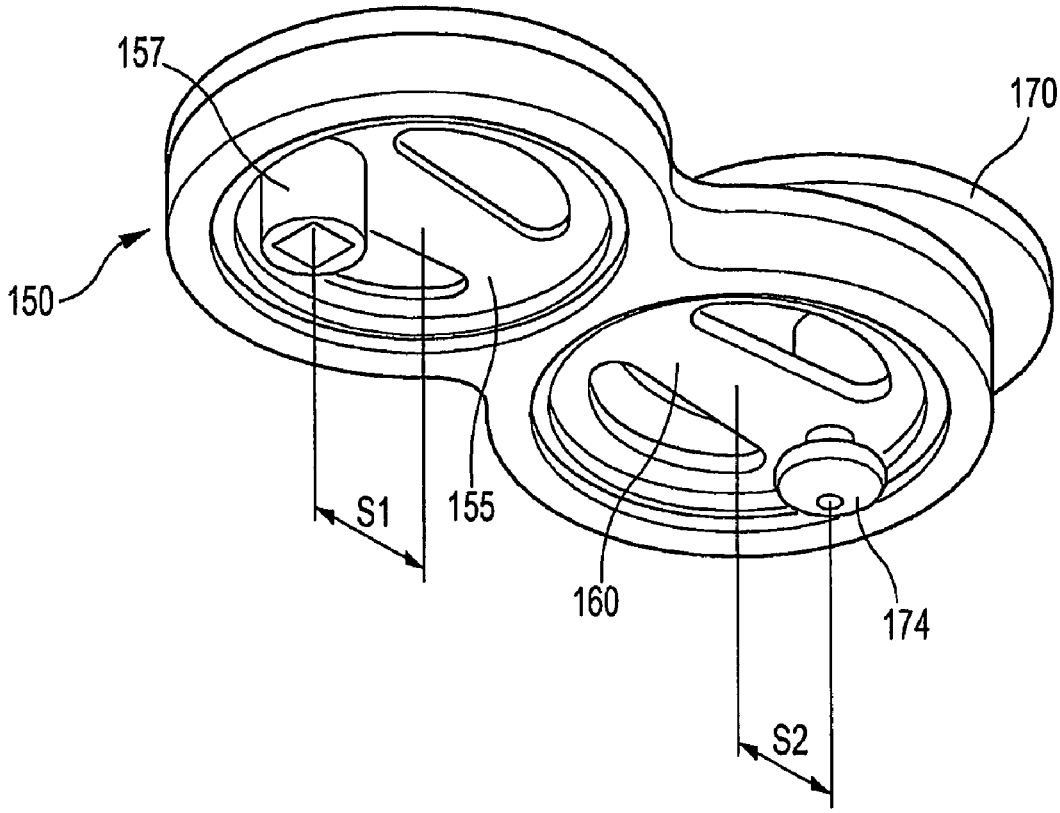
FIG. 4 is a perspective view of a gear assembly in accordance with at least one embodiment.
Figure 5:
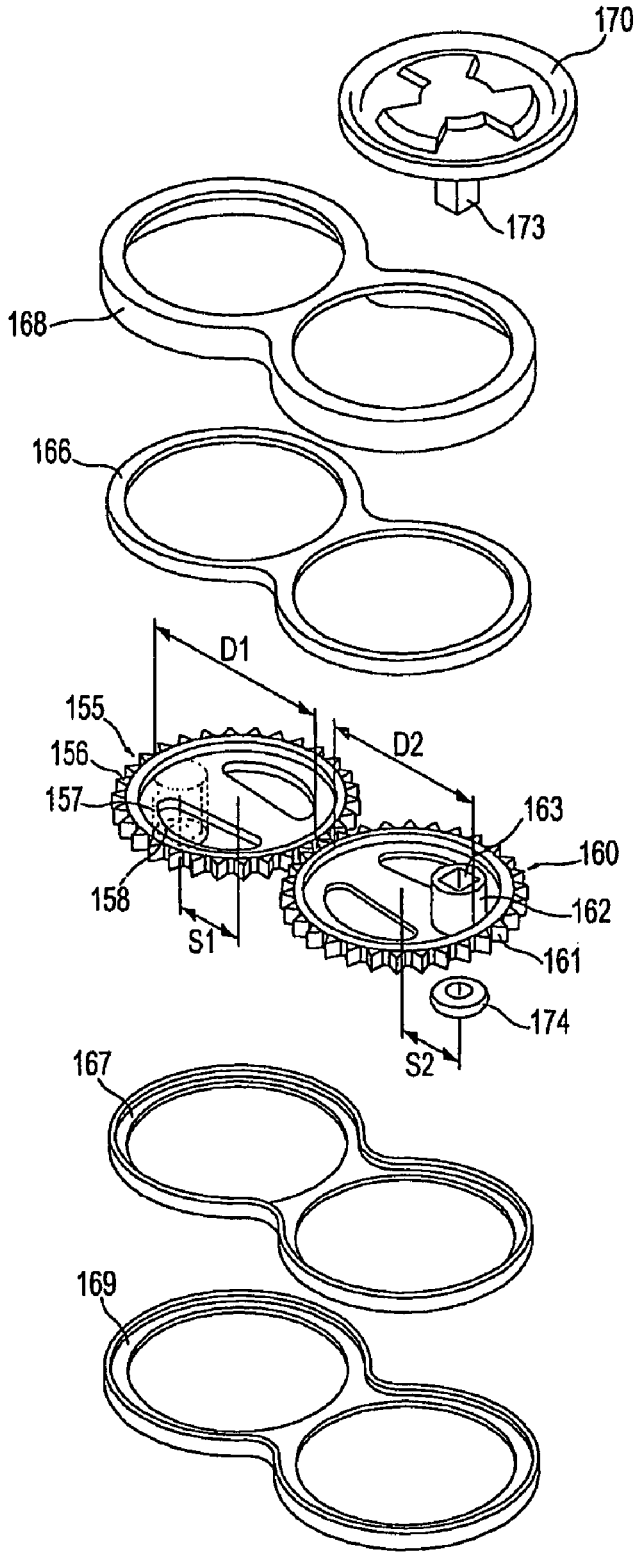
FIG. 5 is an exploded perspective view of the gear assembly in accordance with at least one embodiment.
Figure 6:
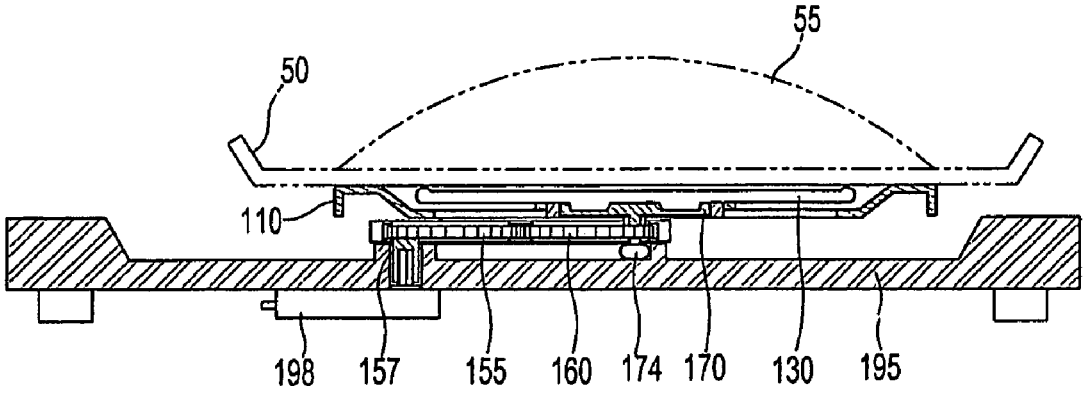
FIG. 6 is a longitudinal-sectional view of FIG. 2.

FIG. 1 is an exploded perspective view of a microwave oven in accordance with at least one embodiment, FIG. 2 is a perspective view illustrating an installation state of a tray in a cooking room, FIG. 3 is an exploded perspective view of FIG. 2, FIG. 4 is a perspective view of a gear assembly, FIG. 5 is an exploded perspective view of the gear assembly, and FIG. 6 is a longitudinal-sectional view of FIG. 2.

A microwave oven 1 in accordance with an embodiment includes a main body 10 forming the external appearance of the microwave oven, as shown in FIG. 1, and the main body 10 includes a front plate 11 and a rear plate 12 respectively forming front and rear surfaces of the main body 10, a bottom plate 13 forming a bottom surface of the main body 10, and a cover 14 forming both side surfaces and a top surface of the main body 10.

An inner case 40 having a rectangular parallelepiped shape, the front surface of which is opened, to form a cooking room 20 at the inside thereof and a machine room 30 at the outside thereof is provided in the main body 10. A door 11*a* hinged to the front plate 11 to open and close the cooking room 20 and a control panel 11*b*, on which a plurality of input devices, such as operation buttons, to operate the microwave oven 1 overall is installed, are provided on the front plate 11.

A magnetron 31 to generate high frequency radiation supplied to the inside of the cooking room 20, a high voltage transformer 32 and a high voltage condenser 33 to apply high voltage to the magnetron 31, and a cooling fan 34 to cool respective parts within the machine room 30 are installed in the machine room 30 next to the cooking room 20. A tray 100 installed on the bottom of the cooking room 20 such that food to be cooked is mounted on the tray 100 and a waveguide (not shown) to guide the high frequency radiation irradiated from the magnetron 31 to the inside of the cooking room 20 are installed in the cooking room 20.

When the microwave oven is driven to irradiate high frequency radiation to the inside of the cooking room 20 through the above structure under the condition food is placed on the tray 100, the food in the cooking room 20 is cooked by friction heat between molecules generated by repeated change of a molecular arrangement of moisture contained within the food due to the high frequency radiation irradiated to the inside of the cooking room 20.

The tray 100 is disposed on a bottom surface 195 of the cooking room 20, and includes a sub-tray 110 rectilinearly reciprocated, and a circular rotary tray 130 rotated on the sub-tray 110.

The sub-tray 110 has a rectangular shape, and moving rollers 113*a*, 113*b*, 113*c*, and 113*d* are installed at the lower surfaces of respective corners of the sub-tray 110, but the position and number of rollers is not limited thereto. The moving rollers 113*a*, 113*b*, 113*c*, and 113*d* are rectilinearly reciprocated along moving roller grooves 196*a* and 196*b* formed on the cooking room bottom surface 195.

A rotary tray reception part 118, in which the rotary tray 130 is received, is formed at the central region of the sub-tray 110, and a roller guide 115 contacting the rotary tray 130 to facilitate the rotation of the rotary tray 130 is formed on the inner circumferential surface of the rotary tray reception part 118. The roller guide 115 may be formed integrally with the sub-tray 110, or may be manufactured separately from the sub-tray 110 and be disposed between the sub-tray 110 and the cooking room bottom surface 195.

The rotary tray 130 generally has a circular shape, and is generally made of glass, but is not limited thereto. The rotary tray 130 is received in the rotary tray reception part 118 formed on the sub-tray 110, and is connected to a coupler 170 of a gear assembly 150, which will be described later, by a through hole 119 formed at the center of the rotary tray reception part 118.

A damping member 117 is interposed between the inner circumferential surface of the through hole 119 and the coupler 170. The coupler 170 is rotated and thus serves to push the sub-tray 110 right and left. Since the coupler 170 performs both a rotary motion and a right and left rectilinear motion, and the sub-tray 110 performs a right and left rectilinear motion, the damping member 117 therebetween serves to minimize and buffer friction therebetween.

The gear assembly 150, as shown in FIGS. 3 to 5, is disposed between the sub-tray 110 and the cooking room bottom surface 195, and changes power supplied by a motor 198 to drive the tray 100.

The gear assembly 150 includes a main gear 155 connected to the motor 198 and thus rotated, and a planetary gear 160 engaged with the main gear 155 and thus rotated. The coupler 170 is connected to the upper surface of the planetary gear 160.

The main gear 155 having a circular shape is formed to have a designated diameter D1, and is provided with main gear saw-teeth 156 on the outer circumferential surface thereof such that the main gear 155 is engaged with the planetary gear 160. A main gear eccentric shaft 157 having a designated eccentric distance S1 from the center O1 (see FIG. 7A, for example) of the main gear 155 is protruded from the lower surface of the main gear 155, and a motor connection hole 158 connected to a motor shaft 199 is formed within the main gear eccentric shaft 157.

The planetary gear 160 is also provided with planetary gear saw-teeth 161 on the outer circumferential surface thereof such that the planetary gear 160 is engaged with the main gear 155, and is formed to have a designated diameter D2. A planetary gear eccentric shaft 162 having a designated eccentric distance S2 from the center O2 (see FIG. 7A, for example) of the planetary gear 160 is protruded from the upper surface of the planetary gear 160, and a coupler connection hole 163 connected to a coupler shaft 173 is formed within the planetary gear eccentric shaft 162. The coupler shaft 173 passes through the coupler connection hole 163, and is connected to a guide protrusion 174.

Here, the diameters D1 and D2 of the main gear 155 and the planetary gear 160 and the eccentric distances S1 and S2 of the main gear eccentric shaft 157 and the planetary gear eccentric shaft 162 are respectively equal to each other. The reason behind this configuration, which will be described in detail during a description of an operating process of the microwave oven 1, is that the sub tray 110 and the rotary tray 130 are moved at a uniform speed, and torque generated from the motor 198 is finally transmitted to the rotary tray 130.

The saw-teeth 156 and 161 of the main gear 155 and the planetary gear 160 are surrounded by an upper gear guide 166 and a lower gear guide 167. The upper gear guide 166 and the lower gear guide 167 serve as sliding bearings, which maintain the engagement between the main gear 155 and the planetary gear 160 and minimize friction generated from the rotation of the main gear 155 and the planetary gear 160. The gear guides 166 and 167 are made of a material having a low coefficient of friction to facilitate the rotation of the gears 155 and 160.

Further, the external surfaces of the gear guides 166 and 167 are surrounded by an upper casing 168 and a lower casing 169. The casings 168 and 169 form the external appearance of the gear assembly 150, and maintain the strength of the gear assembly 150.

A stirrer 180 is attached to the upper surface of the main gear 155. The stirrer 180 serves to disperse high frequency radiation in the cooking room 20 to uniformly cook food in the cooking room 20.

The gear assembly 150 is connected to a base guide 185 formed at the central region of the cooking room bottom surface 195. The base guide 185 includes a main gear shaft hole 187, into which the main gear eccentric shaft 157 is inserted, and a guide groove 189, into which the guide protrusion 174 is inserted, formed at one side of the main gear shaft hole 187 and serving as a movement path of the guide protrusion 174. Here, the base guide 185 is formed integrally with the cooking room bottom surface 195.

The motor 198 is connected to the lower part of the cooking room bottom surface 195. The motor 198 is connected to the cooking room bottom surface 195 by inserting the motor shaft 199 of the motor 198 into the main gear eccentric shaft 157.

In order to make provisions for the case that a dish 50 having a larger size than that of the rotary tray 130 is placed on the tray 100, as shown in FIG. 6, the upper surface of the sub-tray 110 is disposed at a higher position than that of the upper surface of the rotary tray 130, and the rotary tray 130 is received in the rotary tray reception part 118 formed on the sub-tray 110. Therefore, although the dish 50 having a larger size than that of the rotary tray 130 is placed on the tray 100, the dish 50 does not contact the rotary tray 130 and thus is not affected by the rotation of the rotary tray 130, and is rectilinearly reciprocated to the right and left under the condition that the dish 50 is placed on the upper surface of the sub-tray 110, thereby allowing food 55 in the dish 50 to be cooked.

Hereinafter, the process and principle of driving the tray 100 of the microwave oven 1 in accordance with an embodiment will be described.

Figure 7A:
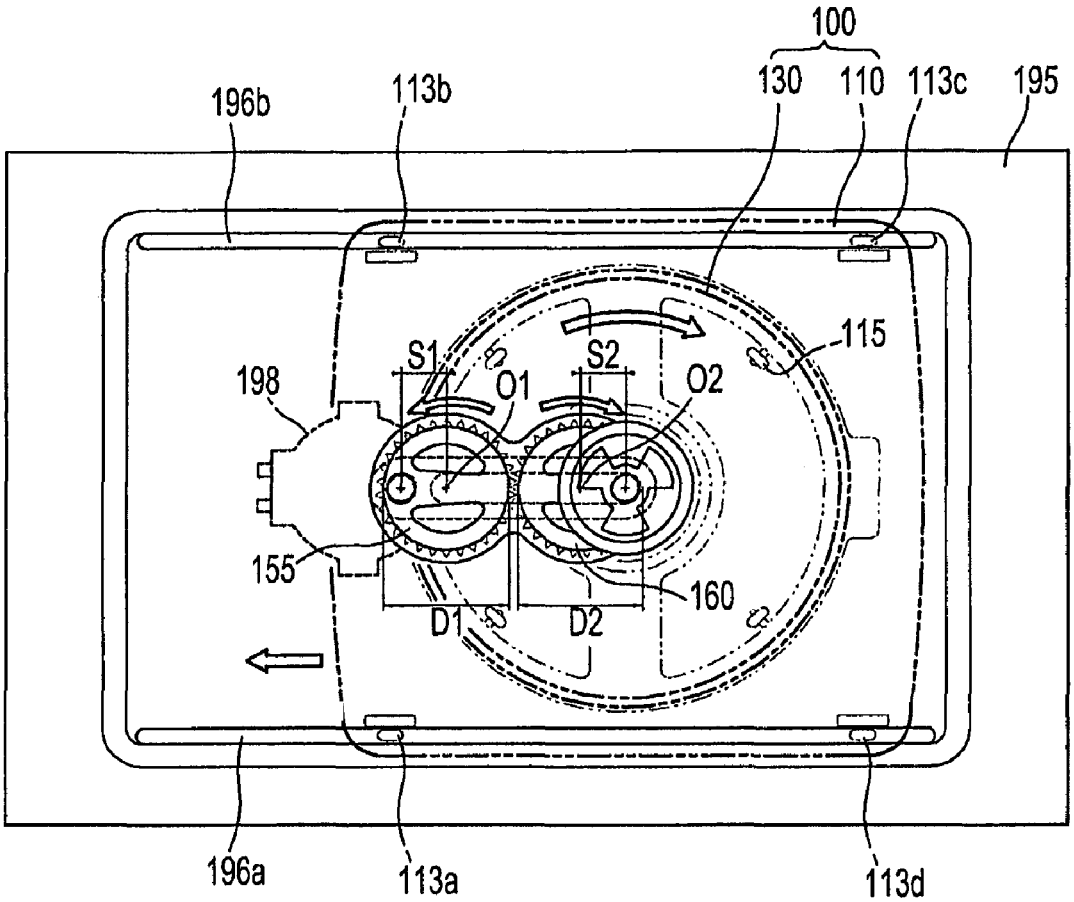
FIGS. 7A to 7C are plan views illustrating a driving state of the tray.
Figure 7B:
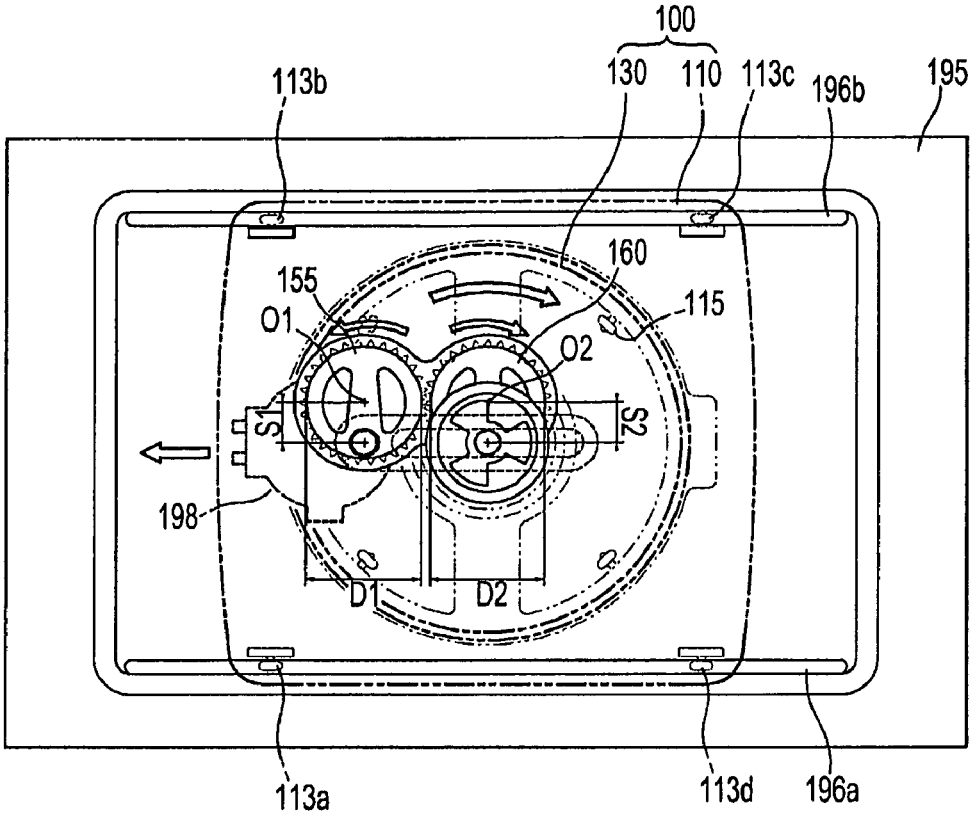
Figure 7C:
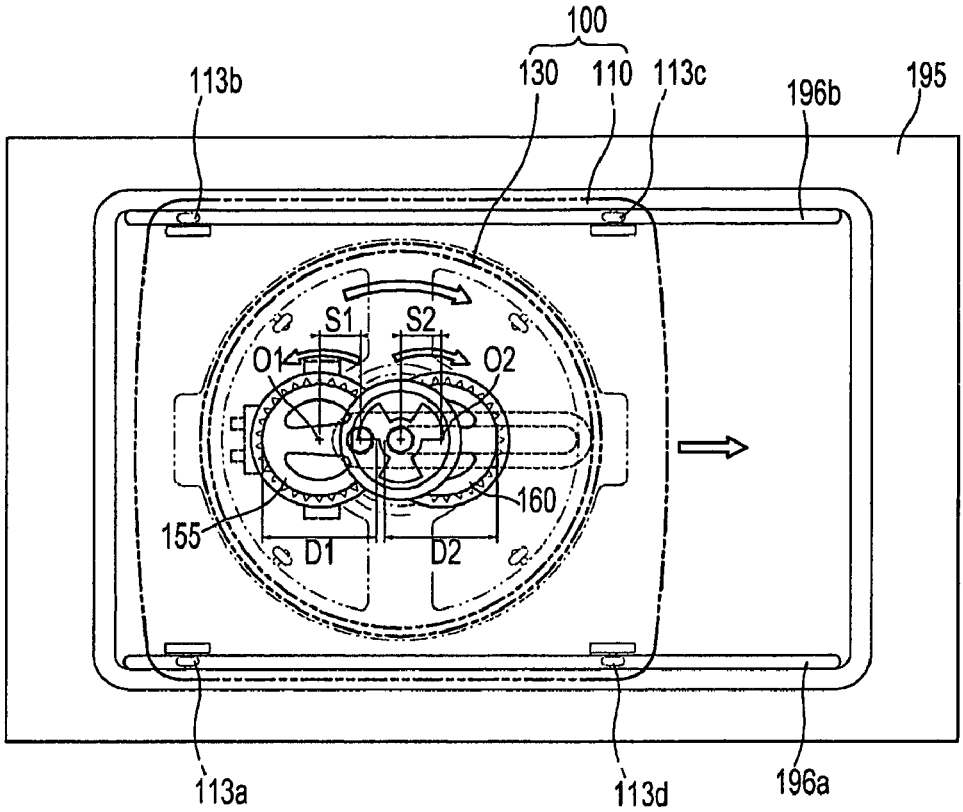

FIGS. 7A to 7C are plan views illustrating a driving state of the tray 100.

First, as shown in FIG. 7A, when a user connects the microwave oven 1 to a power supply source and presses an operation button of the control panel 11*b*, and then the motor shaft 199 of the motor 198 is rotated in the counterclockwise direction, rotary power is transmitted to the main gear eccentric shaft 157 eccentrically separated from the main gear center O1 of the main gear 155 by the distance S1, and the main gear 155 is rotated around the main gear eccentric shaft 157 in the counterclockwise direction.

Further, the planetary gear 160 engaged with the main gear 155 is also rotated. The planetary gear 160 is rotated around the planetary gear eccentric shaft 162, eccentrically separated from the planetary gear center O2 of the planetary gear 160 by the distance S2, in the clockwise direction.

Since the planetary gear eccentric shaft 162 is connected to the guide protrusion 174 and the guide protrusion 174 is inserted into the guide groove 189 formed on the cooking room bottom surface 195, the planetary gear eccentric shaft 162 is forcibly moved along the guide groove 189 and is rotated. Simultaneously, the coupler 170 connected to the upper part of the planetary gear eccentric shaft 162 is rectilinearly moved from the right end of the guide groove 189 to the left and is rotated in the clockwise direction.

Then, the rotary tray 130 mounted on the upper surface of the coupler 170 starts to be rectilinearly moved from the right to the left and is rotated in the clockwise direction simultaneously, and the sub-tray 110 starts to be rectilinearly moved to the left, i.e., the rectilinear moving direction of the coupler 170.

During a process of moving the planetary gear eccentric shaft 162 to the left of the guide groove 189, the main gear 155 and the planetary gear 160 are in a disposition state, as shown in FIG. 7B. That is, while the main gear 155 and the planetary gear 160 are rotated under the condition that they are engaged with each other, the main gear 155 and the planetary gear 160 are biased to the upper part of the base guide 185, but the coupler 170 is located on the guide groove 189 together with the planetary gear eccentric shaft 162.

When the planetary gear eccentric shaft 162 is continuously moved to the left of the guide groove 189 and reaches the left end of the guide groove 189, a disposition state, as shown in FIG. 7C, is obtained. The main gear 155 and the planetary gear 160 biased to the upper part of the base guide 185 are in alignment with the base guide 185 again, and the main gear eccentric shaft 157 and the planetary gear eccentric shaft 162 are located at the closest positions during the process of moving the tray 100.

Thereafter, when the main gear 155 is continuously rotated in the counterclockwise direction, the main gear 155 and the planetary gear 160 are moved to be biased to the lower part of the base guide 185 and are returned to the state of FIG. 7A. Then, the tray 100 is driven by repeating the process of FIG. 7B and FIG. 7C.

The overall motion of the tray 100 will be simplified as follows. The main gear eccentric shaft 157 performs a rotary motion under the condition that the position of the main gear eccentric shaft 157 is fixed to the main gear shaft hole 187, and the planetary gear eccentric shaft 162 performs both a rectilinear reciprocating motion to the right and left along the guide groove 189 of the base guide 185 and a rotary motion. Thus, the coupler 170 connected to the planetary gear eccentric shaft 162 performs both a rectilinear reciprocating motion to the right and left and a rotary motion also.

The rotary tray 130 connected to the upper surface of the coupler 170 performs both a rectilinear reciprocating motion to the right and left and a rotary motion in the same manner as the coupler 170, and the sub-tray 110 is pushed to the right and left by the coupler 170 and thus performs only a rectilinear reciprocating motion to the right and left along the moving roller grooves 196*a* and 196*b* formed on the cooking room bottom surface 195.

When the tray 100 is driven in this way, the main gear 155 and the planetary gear 160 are configured such that the diameters D1 and D2 and the eccentric distances S1 and S2 of the main gear 155 and the planetary gear 160 are respectively equal to each other. When the diameters D1 and D2 or the eccentric distances S1 and S2 of the main gear 155 and the planetary gear 160 differ from each other, the rotating speed of the planetary gear eccentric shaft 162 of the planetary gear 160 engaged with the main gear 155 may not be uniform, and the torque transmitted to the coupler 170 through the planetary gear eccentric shaft 162 is frequently varied. Consequently, the rotary tray 130 is not rotated at a uniform speed and the rotary tray 130 and the sub-tray 110 are not rectilinearly reciprocated at a uniform speed, thus causing food not to be uniformly cooked.

That is, in order to move the sub-tray 110 and the rotary tray 130 at a uniform speed and transmit the torque generated from the motor 198 finally to the rotary tray 130, the main gear 155 and the planetary gear 160 are configured such that the diameters D1 and D2 and the eccentric distances S1 and S2 of the main gear 155 and the planetary gear 160 are respectively equal to each other. Further, since the torque generated from the motor 198 is transmitted to the tray 100 without change in the magnitude of the torque, the tray 100 may be driven even using a motor having a smaller load capacity than that of a conventional motor, and power consumption of the tray 100 is reduced.

Although the main gear 155 and the planetary gear 160 are configured such that the diameters D1 and D2 and the eccentric distances S1 and S2 of the main gear 155 and the planetary gear 160 are respectively equal to each other, even if the diameters D1 and D2 and the eccentric distances S1 and S2 respectively differ from each other in a manner different from the above description, the rotary motion of the rotary tray 130 and the rectilinear reciprocating motion of the sub-tray 110 are still achieved. However, in this case, the speed of the rotary motion of the rotary tray 130 and the speed of the rectilinear reciprocating motion of the sub-tray 110 are not uniform.

Hereinafter, another embodiment will be described in detail with reference to the accompanying drawings. A detailed description of elements of this embodiment, which are substantially the same as those of the embodiment of FIG. 3, will be omitted because it is considered to be unnecessary.

Figure 8:
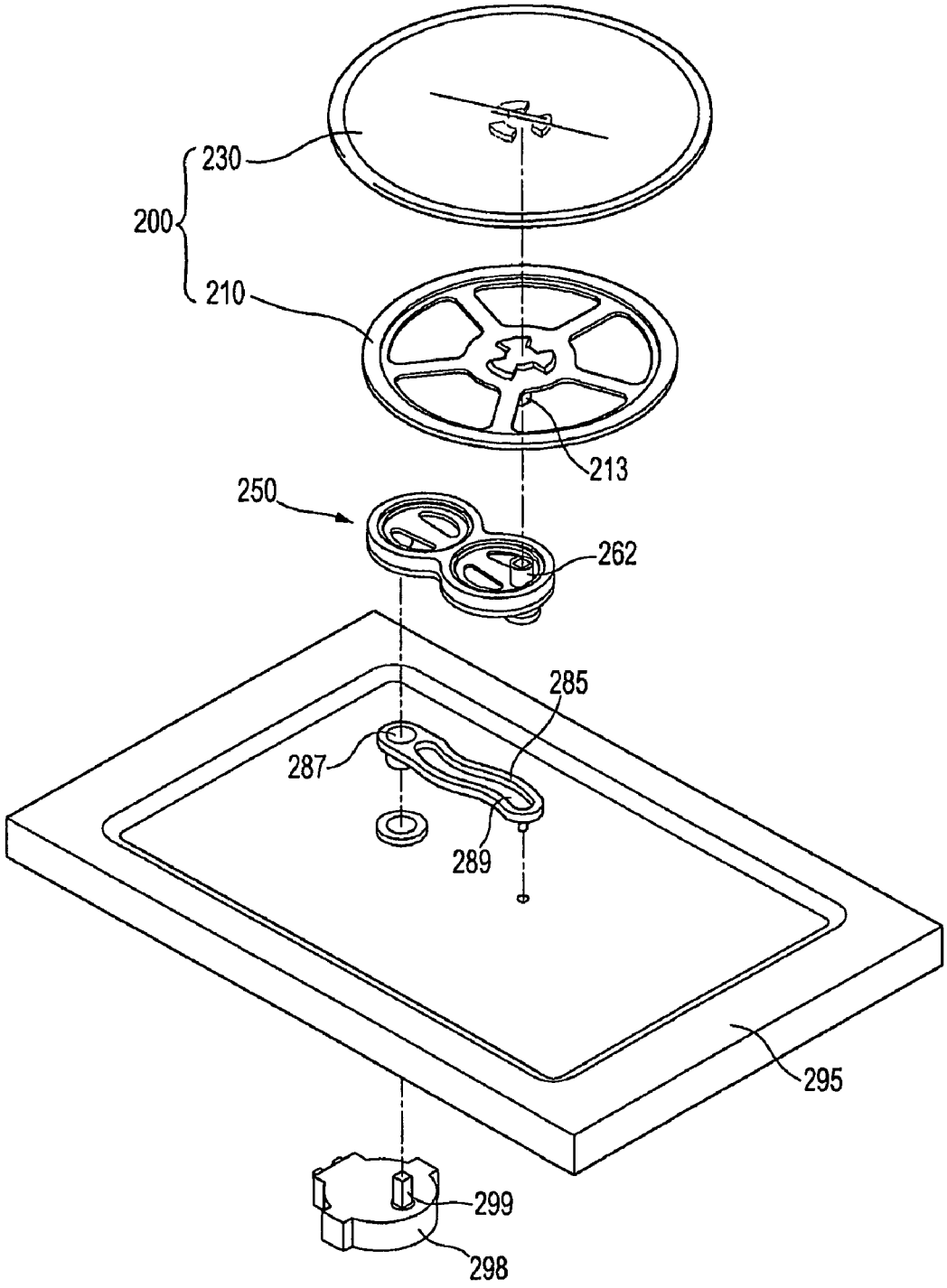
FIG. 8 is an exploded perspective view of a tray in accordance with at least one embodiment.
Figure 9:
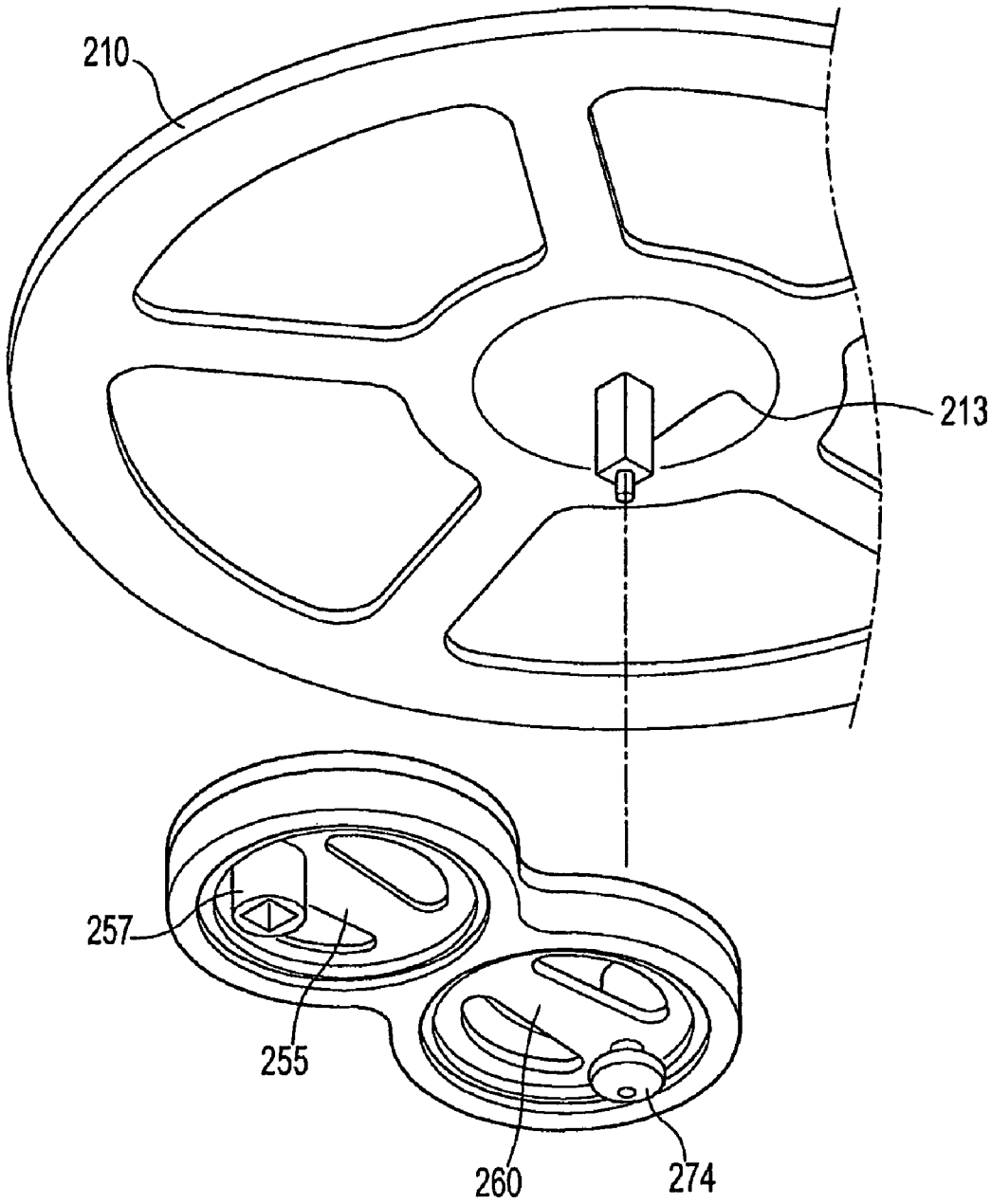
FIG. 9 is an exploded perspective view of a gear assembly and a sub-tray in accordance with at least one embodiment.
Figure 10:
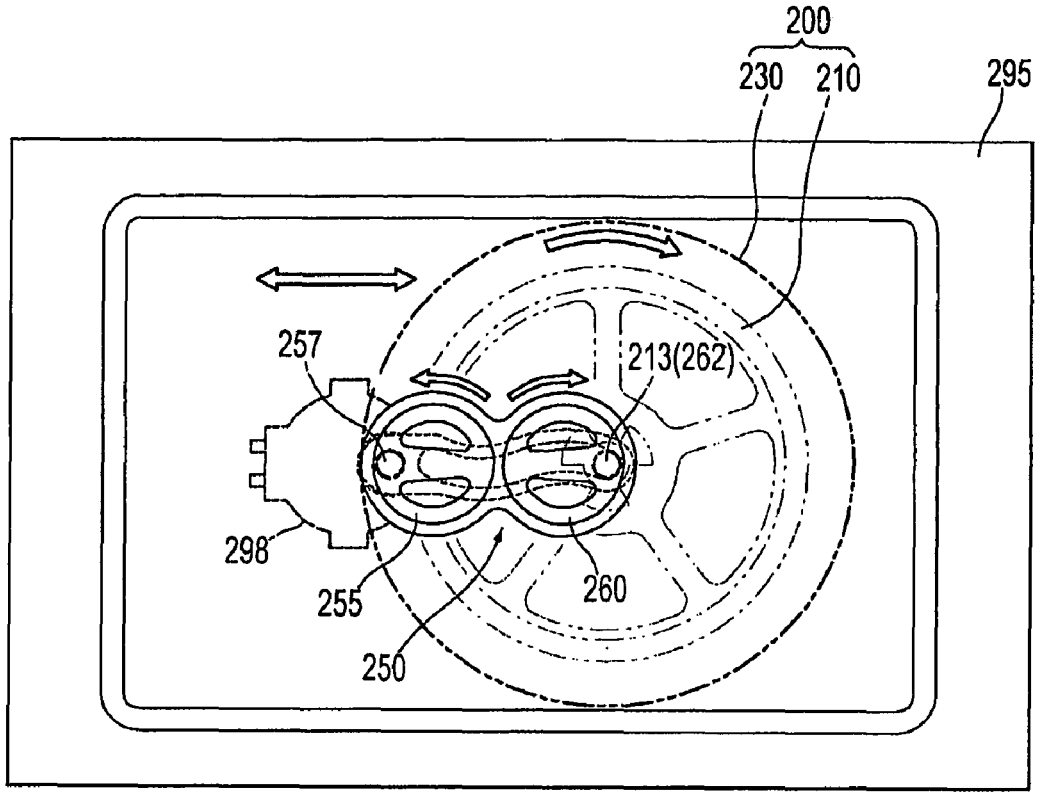
FIG. 10 is a plan view illustrating a driving state of the tray in accordance with at least one embodiment.

FIG. 8 is an exploded perspective view of a tray, FIG. 9 is an exploded perspective view of a gear assembly and a sub-tray, and FIG. 10 is a plan view illustrating a driving state of the tray.

With reference to FIGS. 8 and 9, a tray 200 in accordance with this embodiment is disposed on a cooking room bottom surface 295 in the same manner as the embodiment of FIG. 3. Further, the internal structure of a gear assembly 250 of this embodiment is the same as that of the gear assembly 150 of the embodiment of FIG. 3. Particularly, the gear assembly 250 includes a main gear 255 having a main gear eccentric shaft 257, and a planetary gear 260 having a planetary gear eccentric shaft 262 and a guide protrusion 274.

However, the gear assembly 250 does not include the coupler 170 of the embodiment of FIG. 3, and instead a sub-tray 210 serves as the coupler. The sub-tray 210 has a circular shape, and is formed to have a smaller radius than that of a rotary tray 230. A fixing coupler 213 is fixed to the lower surface of the sub-tray 210 by welding, for example, or in any other type of connectable manner, and is inserted into a planetary gear eccentric shaft 262.

Further, the base guide 185 of the embodiment of FIG. 3 may be formed integrally with the cooking room bottom surface 195, while a base guide 285 of the embodiment of FIG. 8 may be manufactured separately from the cooking room bottom surface 295 and is connected to the cooking room bottom surface 295 through insertion pieces and connecting holes formed through the bottom surface 295 or any of type of connection mechanism that retains the base guide 285 to the bottom surface 295. The base guide 285 includes a main gear shaft hole 287 to receive the main gear eccentric shaft 257 and a guide groove 289 to receive the guide protrusion of the planetary gear 260. A motor 298 is also provided with a motor shaft 299 to be connected with the main gear eccentric shaft 257.

With reference to FIG. 10, the process and principle of driving the tray 200 in accordance with this embodiment will be described. The basic process and principle of driving the tray 200 are the same as those of the tray 100 of the embodiment of FIG. 3. That is, the tray 200 simultaneously performs both a rectilinear reciprocating motion to the right and left and a rotary motion.

However, since the sub-tray 210 has a circular shape and is formed to have a smaller radius than that of the rotary tray 230, food is placed only on the rotary tray 230. Further, the sub-tray 210 simultaneously performs both a rectilinear reciprocating motion to the right and left and a rotary motion in the same manner as the rotary tray 230.

Hereinafter, another embodiment will be described in detail with reference to the accompanying drawings. A detailed description of elements of this embodiment, which are substantially the same as those of the above-described embodiments, will be omitted because it is considered to be unnecessary.

Figure 11:
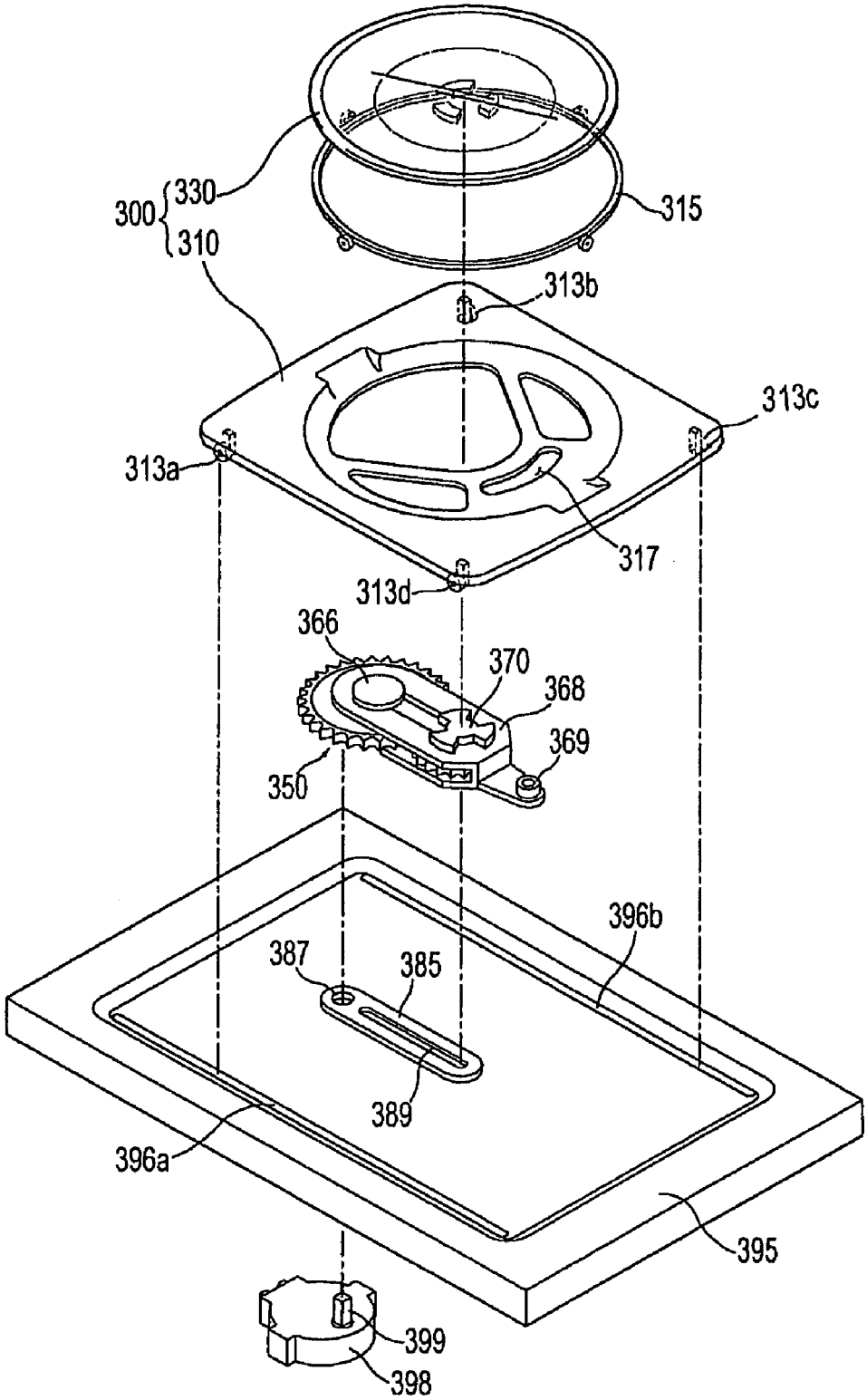
FIG. 11 is an exploded perspective view of a tray in accordance with at least one embodiment.
Figure 12:
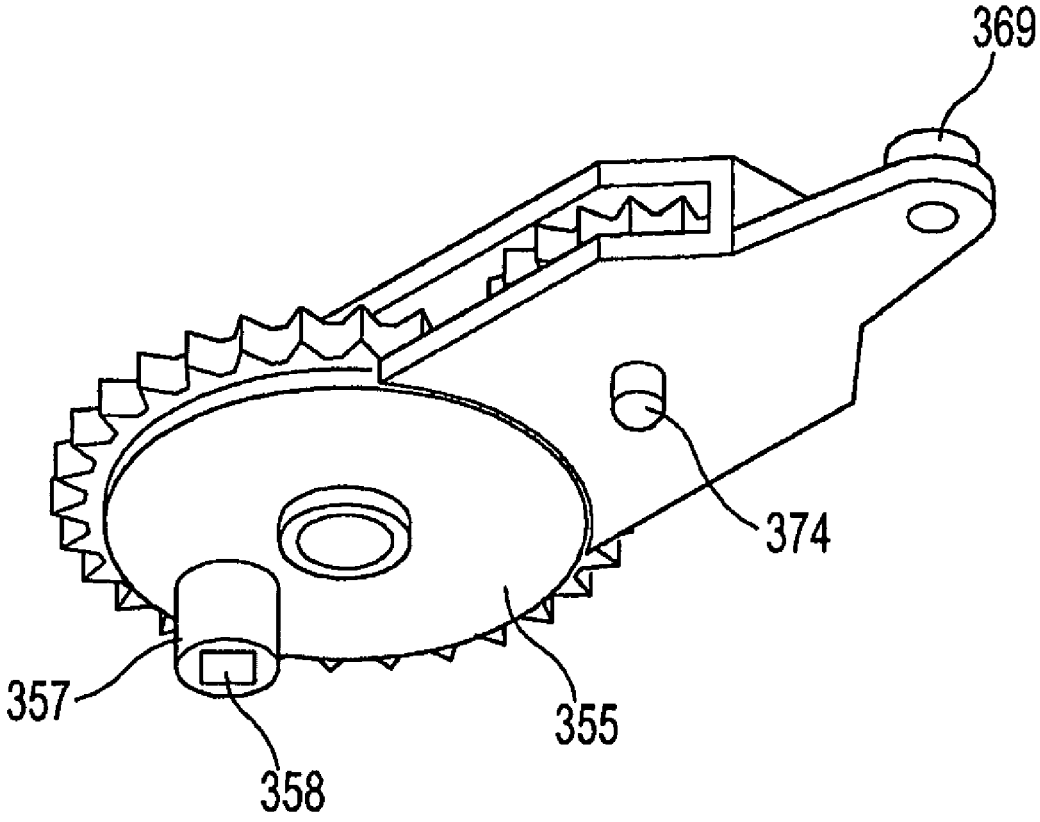
FIG. 12 is a bottom perspective view of a gear assembly in accordance with at least one embodiment.
Figure 13:
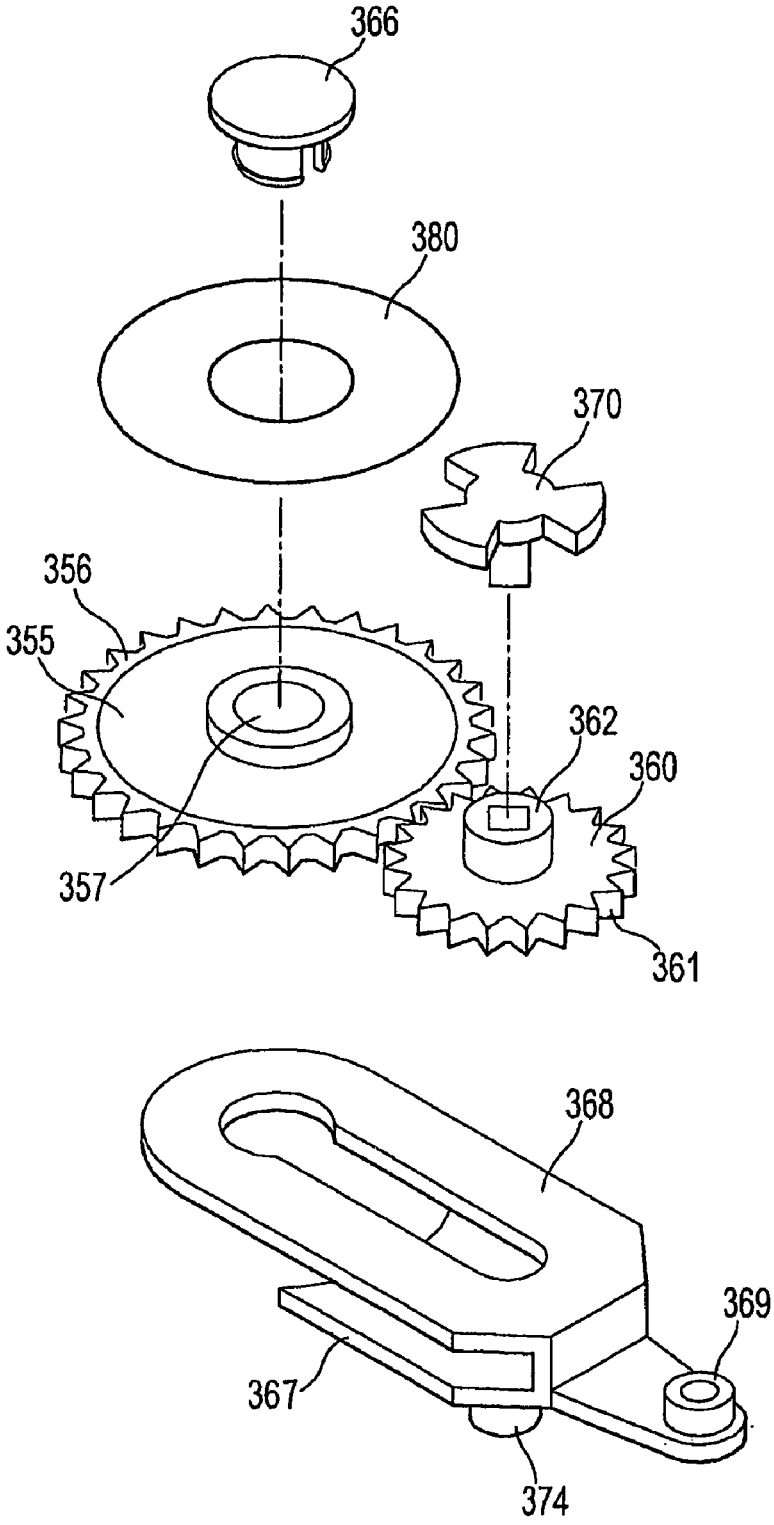
FIG. 13 is an exploded perspective view of the gear assembly in accordance with at least one embodiment.

FIG. 11 is an exploded perspective view of a tray, FIG. 12 is a bottom perspective view of a gear assembly, and FIG. 13 is an exploded perspective view of the gear assembly.

With reference to FIGS. 11 to 13, a tray 300 in accordance with this embodiment is also disposed on a cooking room bottom surface 395, and includes a sub-tray 310 rectilinearly reciprocated, and a circular rotary tray 330 rotated on the sub-tray 310.

The sub-tray 310 also has a rectangular shape, and moving rollers 313*a*, 313*b*, 313*c*, and 313*d* are installed at the lower surfaces of respective corners of the sub-tray 310. The moving rollers 113*a*, 113*b*, 113*c*, and 113*d* are rectilinearly reciprocated along moving roller grooves 396*a* and 396*b* formed on the cooking room bottom surface 395.

The rotary tray 330 is received in the central region of the sub-tray 310, and a roller guide 315 is interposed between the rotary tray 330 and the sub-tray 310. The roller guide 315 contacts the rotary tray 330 and thus facilitates the rotation of the rotary tray 330.

The rotary tray 330 is the same as the rotary tray 130 of the embodiment of FIG. 3.

A gear assembly 350 also includes a main gear 355 connected to a motor 398 and thus rotated, and a planetary gear 360 engaged with the main gear 355 and thus rotated. A coupler 370 is connected to the upper surface of the planetary gear 360.

The main gear 355 having a circular shape is formed to have a designated diameter. A main gear eccentric shaft 357 having a designated eccentric distance from the center of the main gear 355 (similarly to the distance S1 from the center O1 as shown in FIG. 7A) protrudes from the lower surface of the main gear 355, and a motor connection hole 358 connected to a motor shaft 399 is formed within the main gear eccentric shaft 357.

The planetary gear 360 is formed also to have a designated diameter. A planetary gear shaft 362 protrudes from the upper surface of the center of the planetary gear 360. The planetary gear shaft 362 is connected to the coupler 370.

The main gear 355 is provided with main gear saw-teeth 356 on the outer circumferential surface thereof and the planetary gear 360 is provided with planetary gear saw-teeth 361 such that the main gear 155 is engaged with the planetary gear 160 at the saw-teeth 356, 361 portions.

The gear assembly 350 further includes a connection member 368 connecting the main gear 355 and the planetary gear 360 to smoothly engage the main gear 355 and the planetary gear 360. The connection member 368 is provided with a U-shaped hole 367 into which the planetary gear 360 is inserted, and the main gear 355 is mounted on the connection member 368 at the outside of the U-shaped hole 367 by a fixing pin 366.

A connection member pin 369 is formed at one end of the connection member 368, and is inserted into a rectilinear moving groove 317 formed on the sub-tray 310. A guide protrusion 374 is formed on the lower surface of the connection member 368, and is inserted into a guide groove 389 of a base guide 385 and thus rectilinearly moved.

A stirrer 380 is attached to the upper surface of the main gear 355, and serves to uniformly disperse high frequency radiation in the cooking room 20.

The gear assembly 350 is connected to the base guide 385 formed at the central region of the cooking room bottom surface 395. The base guide 385 includes a main gear shaft hole 387, into which the main gear eccentric shaft 357 is inserted, and the guide groove 389, into which a guide protrusion 374 is inserted, formed at one side of the main gear shaft hole 387 and serving as a movement path of the guide protrusion 374. Here, the base guide 385 is formed integrally with the cooking room bottom surface 395. In the alternative, the base guide 385 may be separately attached to the cooking room bottom surface 395.

The motor 398 is connected to the lower part of the cooking room bottom surface 395. The motor 398 is connected to the cooking room bottom surface 395 by inserting the motor shaft 399 of the motor 398 through the main gear shaft hole 387 and into the main gear eccentric shaft 357.

Hereinafter, the process and principle of driving the tray 300 will be described.

Figure 14A:
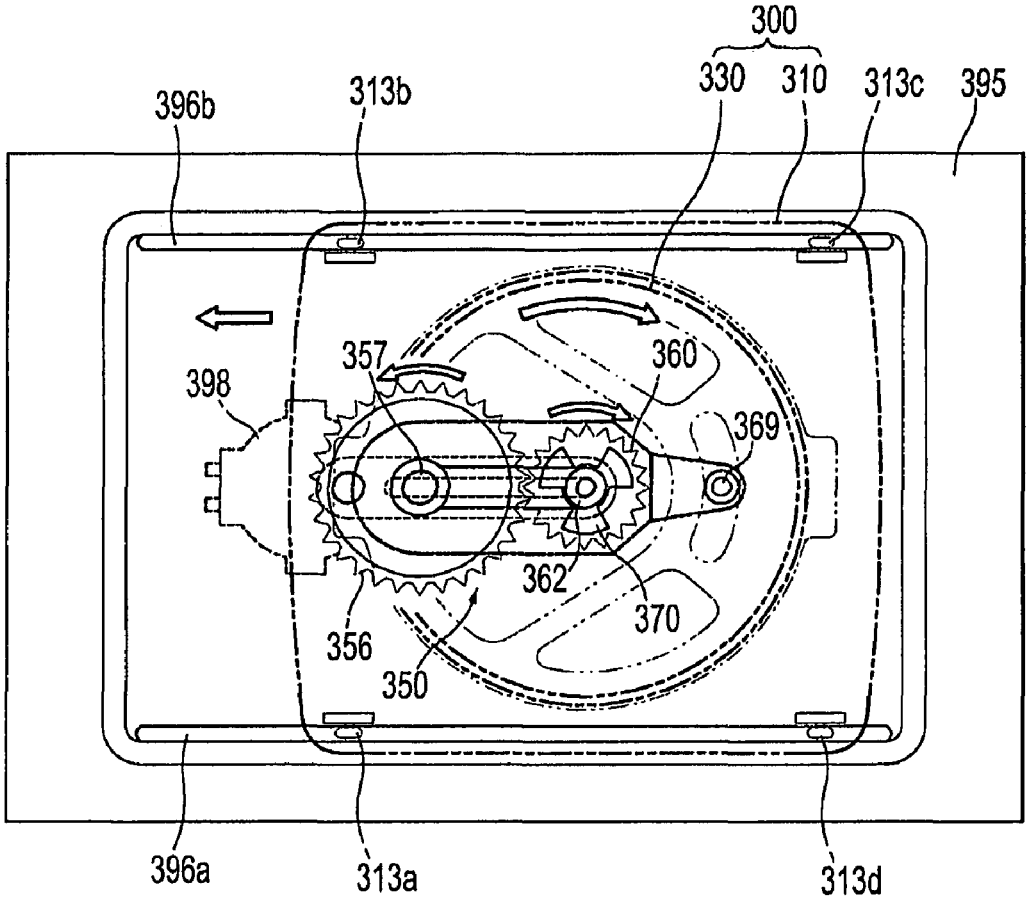
FIGS. 14A to 14C are plan views illustrating a driving state of the tray in accordance with at least one embodiment.
Figure 14B:
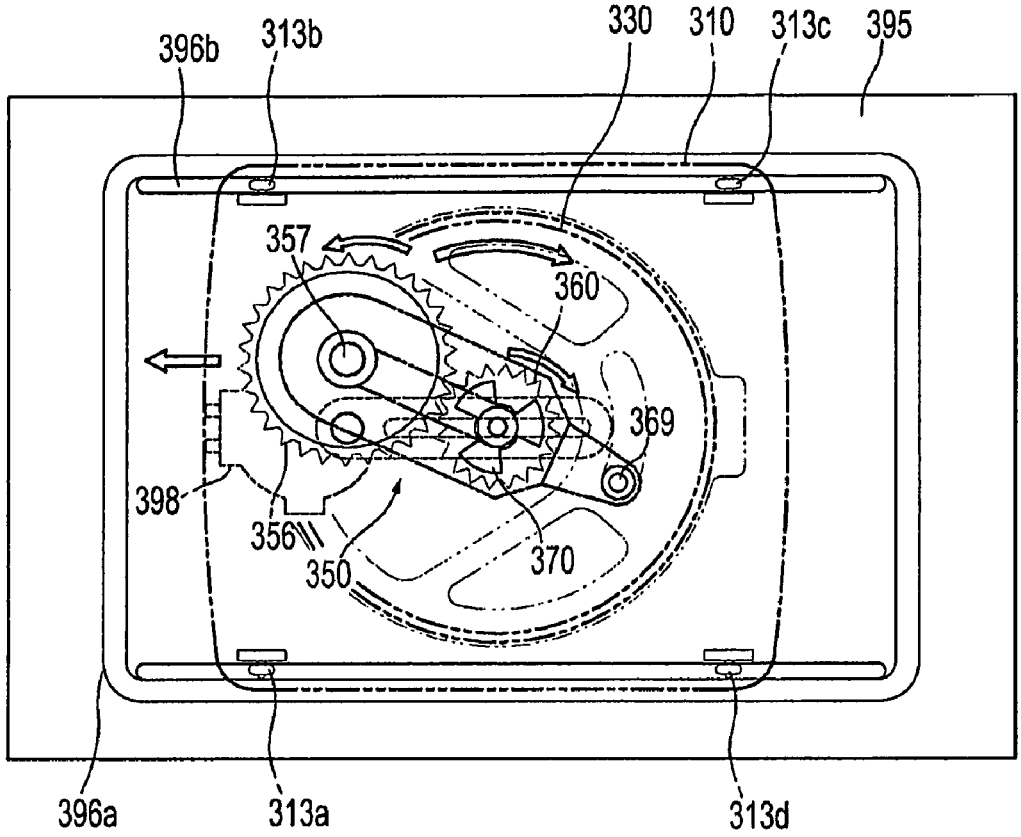
Figure 14C:
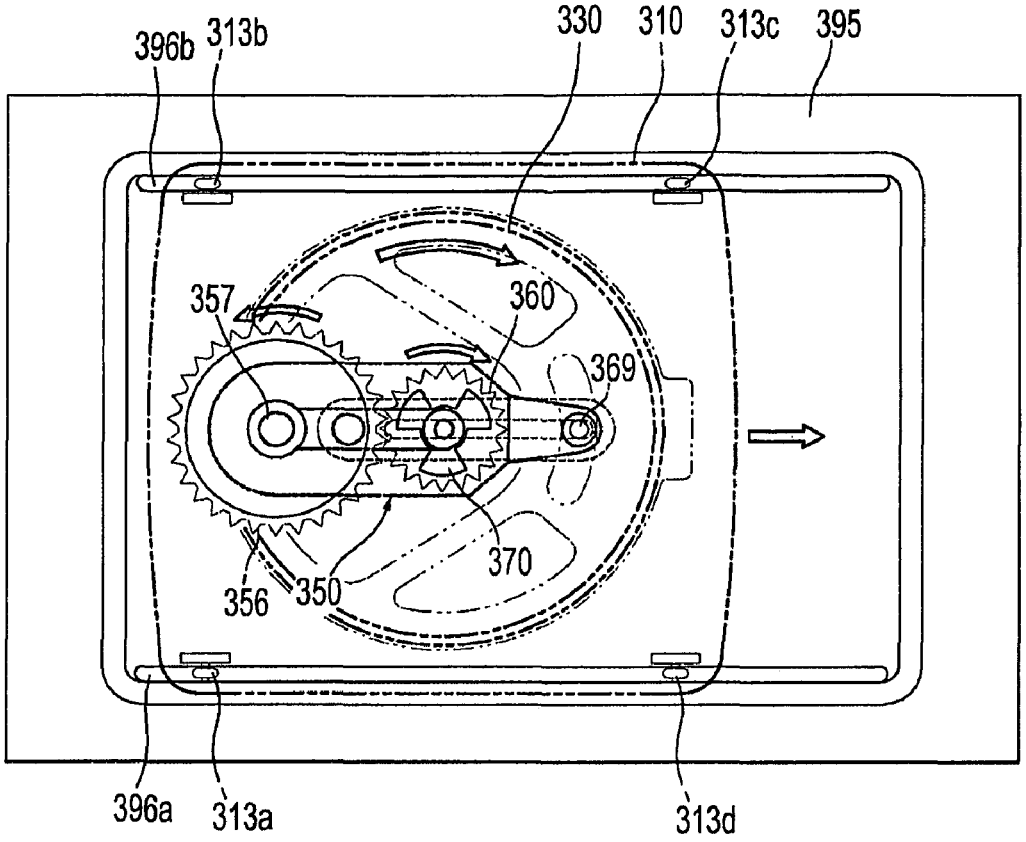

FIGS. 14A to 14C are plan views illustrating a driving state of the tray 300.

First, as shown in FIG. 14A, when a user connects the microwave oven 1 to a power supply source and presses an operation button of the control panel 11*b*, and the motor shaft 399 of the motor 398 is rotated in the counterclockwise direction, rotary power is transmitted to the main gear eccentric shaft 357, and the main gear 355 is rotated around the main gear eccentric shaft 357 in the counterclockwise direction.

Further, the planetary gear 360 engaged with the main gear 355 is also rotated. The planetary gear 360 is rotated around the planetary gear shaft 362 in the clockwise direction.

Since the planetary gear shaft 362 is connected to the guide protrusion 374 and the guide protrusion 374 is inserted into the guide groove 389 formed on the cooking room bottom surface 395, the planetary gear shaft 362 is forcibly moved along the guide groove 389 and is rotated. Simultaneously, the coupler 370 connected to the upper part of the planetary gear shaft 362 is rectilinearly moved from the right end of the guide groove 389 to the left and is rotated in the clockwise direction.

Then, the rotary tray 330 mounted on the upper surface of the coupler 370 starts to be rectilinearly moved from the right to the left and is rotated in the clockwise direction, simultaneously, and the sub-tray 110 starts to be rectilinearly moved to the left, i.e., the rectilinear moving direction of the coupler 370, by the motion of the connection member pin 369.

During a process of moving the planetary gear shaft 362 to the left of the guide groove 389, the main gear 355 and the planetary gear 360 are in a disposition state, as shown in FIG. 14B. That is, while the main gear 355 and the planetary gear 360 are rotated under the condition that they are engaged with each other, the main gear 355 is biased to the upper part of the base guide 385, but the planetary gear 360 is located on the guide groove 389 together with the planetary gear shaft 362.

When the planetary gear shaft 362 is continuously moved to the left of the guide groove 389 and reaches the left end of the guide groove 389, a disposition state, as shown in FIG. 14C, is obtained. The main gear 355 biased to the upper part of the base guide 385 is in alignment with the base guide 385 again, and the main gear eccentric shaft 357 and the planetary gear shaft 362 are located at the closest positions during the process of moving the tray 300.

Thereafter, when the main gear 355 is continuously rotated in the counterclockwise direction, the main gear 355 is moved to be biased to the lower part of the base guide 385 and is returned to the state of FIG. 14A. Then, the tray 300 is driven by repeating the process of FIG. 14B and FIG. 14C.

Hereinafter, yet another embodiment will be described in detail with reference to the accompanying drawings. A detailed description of elements of this embodiment, which are substantially the same as those of the above-described embodiments, will be omitted because it is considered to be unnecessary.

Figure 15:
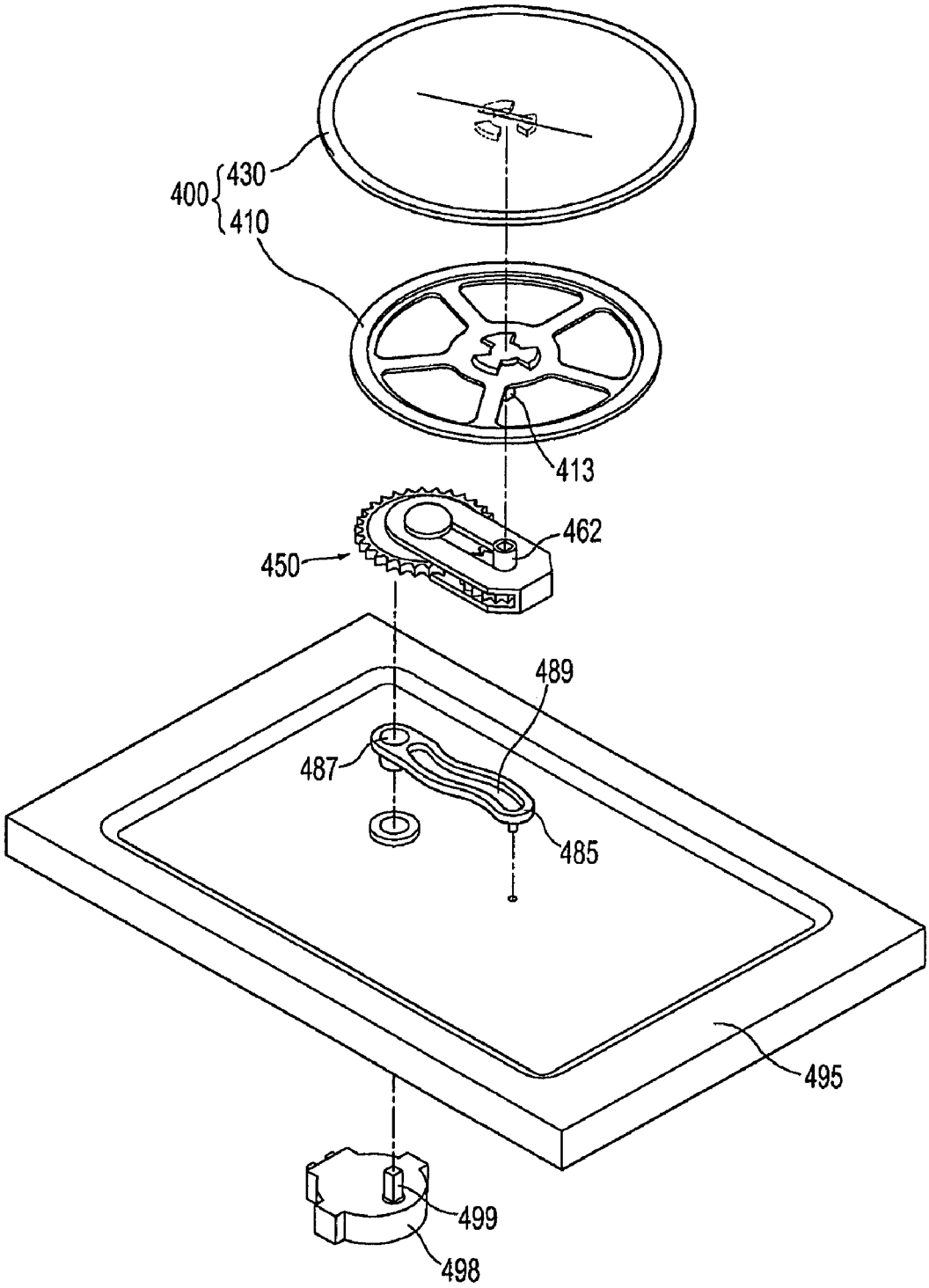
FIG. 15 is an exploded perspective view of a tray and a cooking room in accordance with at least one embodiment.
Figure 16:
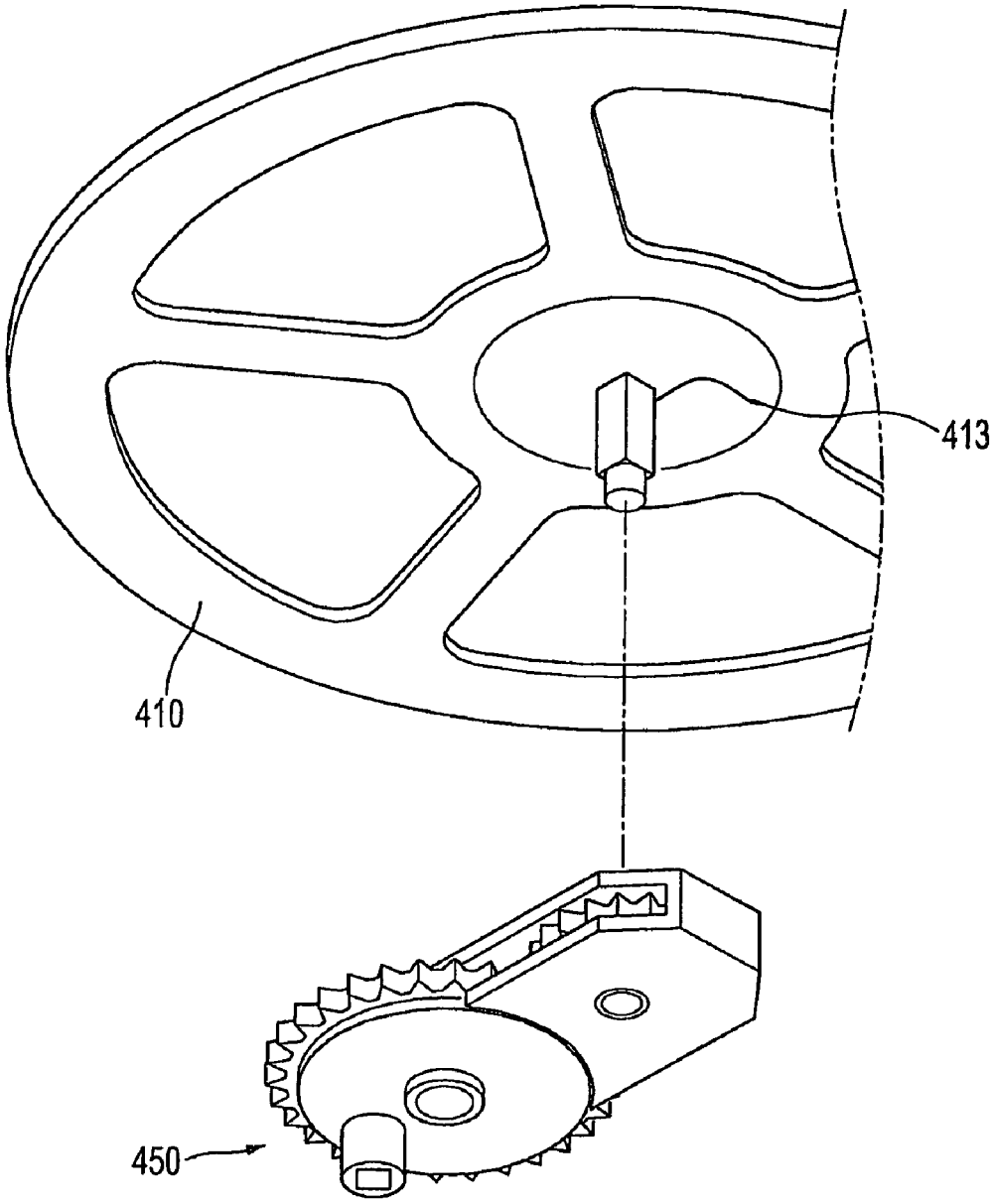
FIG. 16 is an exploded perspective view of a gear assembly and a sub-tray in accordance with at least one embodiment.
Figure 17:
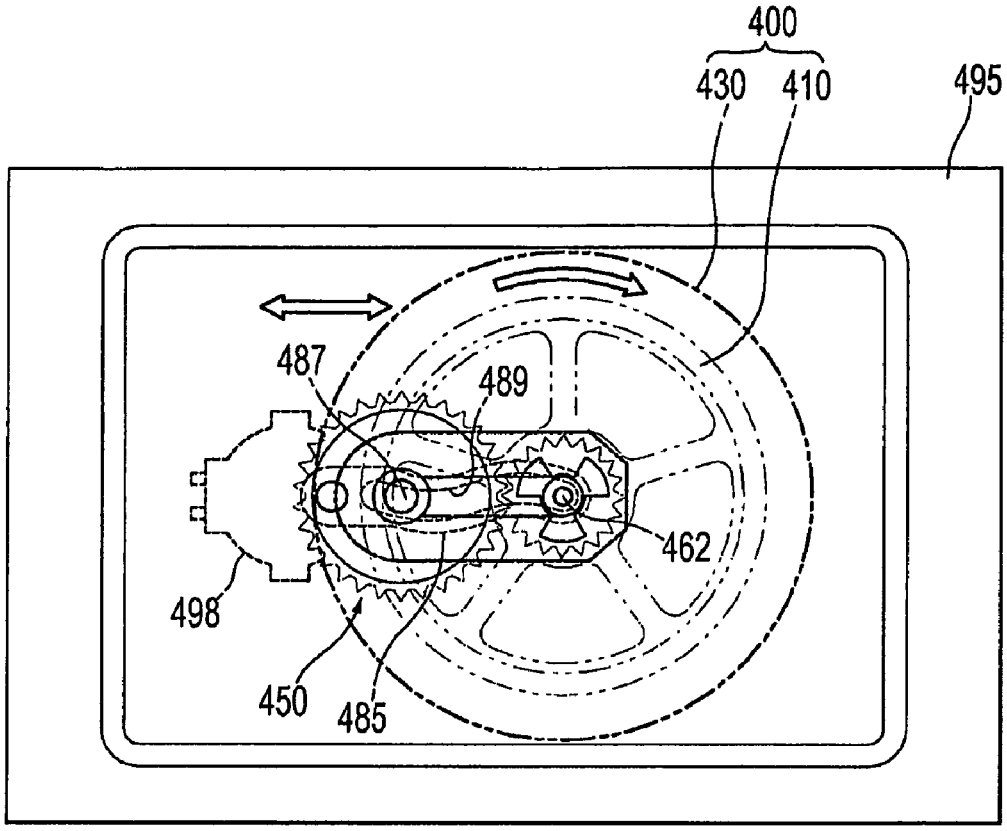
FIG. 17 is a plan view illustrating a driving state of the tray in accordance with at least one embodiment.

FIG. 15 is an exploded perspective view of a tray and a cooking room, FIG. 16 is an exploded perspective view of a gear assembly and a sub-tray, and FIG. 17 is a plan view illustrating a driving state of the tray.

With reference to FIGS. 15 and 16, a tray 400 of this embodiment is the same as the tray 200 of the embodiment of FIG. 8. Further, the internal structure of a gear assembly 450 is the same as that of the gear assembly 350 of the embodiment of FIG. 12.

However, a sub-tray 410 has a circular shape, and is formed to have a smaller radius than that of a rotary tray 430. A fixing coupler 413 fixed to the lower surface of the sub-tray 410 by welding, for example, is inserted into a planetary gear shaft 462.

Further, a base guide 485 is manufactured separately from a cooking room bottom surface 495 and is connected to the cooking room bottom surface 495. However, in the alternative, the base guide 485 may be integrally formed with the cooking room bottom surface 495.

The base guide 485 includes a main gear shaft hole 487, into which the main gear eccentric shaft is inserted, and a curved guide groove 489, into which an end of the fixing coupler 413 is inserted after having been inserted into the planetary gear shaft 462. The curved guide groove 489 is formed at one side of the main gear shaft hole 487 and serves as a movement path of the end of the fixing coupler 413. A motor 498 is connected to the cooking room bottom surface 495 by inserting a motor shaft 499 of the motor 498 through the main gear shaft hole 387 and into a main gear eccentric shaft.

With reference to FIG. 17, the process and principle of driving the tray 400 in accordance with this embodiment will be described. The basic process and principle of driving the tray 400 are the same as those of the above-described embodiments. That is, the tray 400 simultaneously performs both a rectilinear reciprocating motion to the right and left and a rotary motion.

However, since the sub-tray 410 has a circular shape and is formed to have a smaller radius than that of the rotary tray 430, food is placed only on the rotary tray 430. Further, the sub-tray 410 simultaneously performs both a rectilinear reciprocating motion to the right and left and a rotary motion in the same manner as the rotary tray 430.

As is apparent from the above description, in a microwave oven in accordance with one embodiment, a tray is driven by a gear assembly including a main gear and a planetary gear, and thus a sub-tray is rectilinearly reciprocated and a rotary tray is rotated on the sub-tray, simultaneously, thereby achieving cooking of food.

Further, the sub-tray may be rectilinearly reciprocated at a regular speed and the rotary tray may be rotated at a regular speed, simultaneously.

Further, the sub-tray and the rotary tray may be driven even using a motor having a small load capacity.

Moreover, the upper surface of the sub-tray may be disposed at a higher position than that of the upper surface of the rotary tray, so that although a dish having a larger size than that of the rotary tray is placed on the tray, food in the dish may be cooked.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A microwave oven, comprising:

a main body having a cooking room;

a tray disposed on a bottom surface of the cooking room;

a motor to provide power to the tray; and a gear assembly to change the power supplied by the motor to drive the tray, the gear assembly including a main gear connected to the motor and rotatable, and a planetary gear engaged with the main gear and rotatable, and connected to the tray, wherein the main gear and the planetary gear include a shaft disposed off a center of the main gear and a shaft disposed off a center of the planetary gear, respectively.

2. The microwave oven according to claim 1, wherein the tray includes a rectilinearly reciprocated sub-tray and a rotary tray rotated on the sub-tray.

3. The microwave oven according to claim 1, wherein a diameter of the main gear and a diameter of the planetary gear are substantially equal to each other.

4. The microwave oven according to claim 3, wherein a distance between a center of the shaft of the main gear to the center of the main gear and a distance between a center of the shaft of the planetary gear to the center of the planetary gear are equal to each other.

5. The microwave oven according to claim 2, wherein the gear assembly further includes a coupler connected to an upper surface of the planetary gear, the coupler connecting the rotary tray with the gear assembly.

6. The microwave oven according to claim 5, wherein the gear assembly further includes a guide protrusion connected to the planetary gear.

7. The microwave oven according to claim 6, wherein the bottom surface of the cooking room includes a base guide provided with a main gear shaft hole, through which the shaft of the main gear passes to be connected to the motor, and a guide groove, to which the guide protrusion is connected to be moved.

8. The microwave oven according to claim 7, wherein the base guide is formed integrally with the bottom surface of the cooking room.

9. The microwave oven according to claim 1, wherein the gear assembly further includes a stirrer to disperse high frequency radiation in the cooking room.

10. The microwave oven according to claim 2, wherein an upper surface of the sub-tray is disposed at a higher position than that of an upper surface of the rotary tray with respect to the bottom surface of the cooking room.

11. The microwave oven according to claim 10, wherein the rotary tray is received in a rotary tray reception part in the sub-tray.

12. The microwave oven according to claim 3, wherein the gear assembly further includes at least one gear guide surrounding circumferences of the main gear and the planetary gear to facilitate rotation of the main gear and the planetary gear when the main gear and the planetary gear are engaged with each other, and at least one casing surrounding external surfaces of the at least one gear guide.

13. The microwave oven according to claim 2, wherein the gear assembly further includes a connection member connecting the main gear and the planetary gear to facilitate rotation of the main gear and the planetary gear when the main gear and the planetary gear are engaged with each other.

14. The microwave oven according to claim 13, wherein the connection member includes a transmission protrusion formed at one end thereof to transmit power to rectilinearly reciprocate the sub-tray, and the sub-tray includes a transmission protrusion groove, into which the transmission protrusion is inserted to be guided.

15. The microwave oven according to claim 2, wherein the sub-tray has a circular shape, and is formed to have a smaller diameter than that of the rotary tray.

16. The microwave oven according to claim 15, wherein the sub-tray includes a fixing coupler fixed to a lower surface of the sub-tray and connected to the planetary gear.

17. The microwave oven according to claim 2, wherein a roller guide to facilitate rotation of the rotary tray on the sub-tray is disposed between the sub-tray and the rotary tray.

18. The microwave oven according to claim 17, wherein the roller guide is formed integrally with the sub-tray.

19. A tray apparatus of a microwave oven, the tray apparatus comprising:

a sub-tray rectilinearly reciprocated in a lengthwise direction of a cooking room of the microwave oven;

a rotary tray rotated on the sub-tray;

a motor to provide power to the sub-tray and the rotary tray; and a gear assembly connected to the motor to operate the sub-tray and the rotary tray, wherein the gear assembly includes a main gear connected to the motor and rotatable and including a shaft disposed off a center of the main gear, and a planetary gear engaged with the main gear and rotatable and including a shaft disposed off a center of the planetary gear.

20. The tray apparatus according to claim 19, wherein diameters of the main gear and the planetary gear are equal to each other, and distances respectively from the centers of the main gear and the planetary gear to the shafts of the main gear and the planetary gear are substantially equal to each other.

21. A tray apparatus of a microwave oven, the tray apparatus comprising:

a sub-tray rectilinearly reciprocated in a lengthwise direction of a cooking room;

a rotary tray rotated on the sub-tray;

a motor to provide power to the sub-tray and the rotary tray; and a gear assembly connected to the motor to operate the sub-tray and the rotary tray, wherein the gear assembly includes a main gear connected to the motor and rotatable and including shaft disposed off a center of the main gear, and a planetary gear engaged with the main gear and rotatable and including a shaft disposed off a center of the planetary gear.

22. The microwave oven according to claim 16, wherein the bottom surface of the cooking room includes a base guide provided with a main gear shaft hole, through which the shaft formed on the main gear passes to be connected to the motor, and a guide groove, to which the fixing coupler is connected to be moved.

23. The microwave oven according to claim 1, wherein the main gear and the planetary gear include saw-teeth on an outer circumferential surface of the main gear and the planetary gear, respectively, to be engaged with each other, and wherein a diameter of the main gear and a diameter of the planetary gear are substantially equal to each other.

* * * * *

UNITED STATES PATENT AND TRADEMARK OFFICE

CERTIFICATE OF CORRECTION

PATENT NO. : 8,384,001 B2
APPLICATION NO. : 12/662002
DATED : February 26, 2013
INVENTOR(S) : Sang Jin Jeong It is certified that error appears in the above-identified patent and that said Letters Patent is hereby corrected as shown below:

On the Title Page, Column 2 (Primary Examiner), Line 1, Delete “Mattew Reames” and insert -- Matthew Reames --, therefor.

In the Specifications
Column 1, Line 10 (Approx.), Delete “reference” and insert -- reference. --, therefor.

Signed and Sealed this
Second Day of July, 2013

Teresa Stanek Rea
*Acting Director of the United States Patent and Trademark Office*